United States Patent [19]

Trozzi

[11] 4,450,071

[45] May 22, 1984

[54] ADJUSTABLE PARTICLE CLASSIFIER

[75] Inventor: Norman K. Trozzi, West Caldwell, N.J.

[73] Assignee: Foster Wheeler Energy Corporation, Livingston, N.J.

[21] Appl. No.: 396,944

[22] Filed: Jul. 9, 1982

[51] Int. Cl.[3] ..... B04C 5/103

[52] U.S. Cl. ..... 209/144; 209/154; 55/435

[58] Field of Search ..... 209/142–144, 209/154, 210, 211; 53/397, 393, 394; 55/398, 435

[56] References Cited

U.S. PATENT DOCUMENTS

| | | | |
|---|---|---|---|
| 1,128,758 | 2/1915 | Cheesman | 209/143 |
| 1,383,984 | 6/1921 | Clark | 209/144 |
| 1,668,218 | 5/1928 | Sherban | 209/143 |
| 2,101,249 | 12/1937 | Frisch | 209/144 |
| 3,397,780 | 8/1968 | Beuzeval | 209/143 |

*Primary Examiner*—David L. Lacey

*Assistant Examiner*—William Bond

*Attorney, Agent, or Firm*—Marvin A. Naigur; John E. Wilson; Warren B. Kice

[57] ABSTRACT

An adjustable classifier for the separation of fluid-suspended solid particles in industrial processes and by which the relative proportion of acceptably fine and unacceptably coarse solid particles may be regulated. Adjustability is achieved in an otherwise static classifier structure in which a fluid stream of multi-sized particles is passed through a curved path, by the provision of interleaved fingers movable from a retracted inactive position against an outer boundary surface defining the curved path to an extended position into the stream to re-entrain all particles moved against the outer boundary surface back into the fluid stream. Fine particles so re-entrained will pass from the classifier and relatively coarse particles will be rejected by centrifugal action. The invention also contemplates an adjustable plate member by which the velocity of the fluid stream may be regulated independently of the aforementioned fingers.

13 Claims, 7 Drawing Figures

FIG. 1.
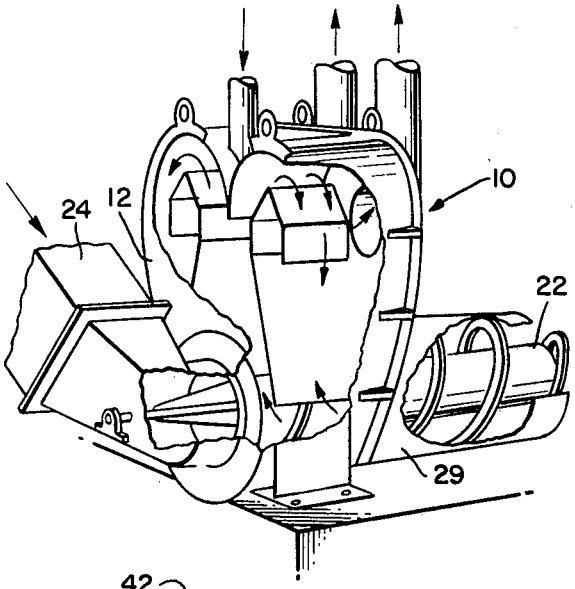
FIG. 2.
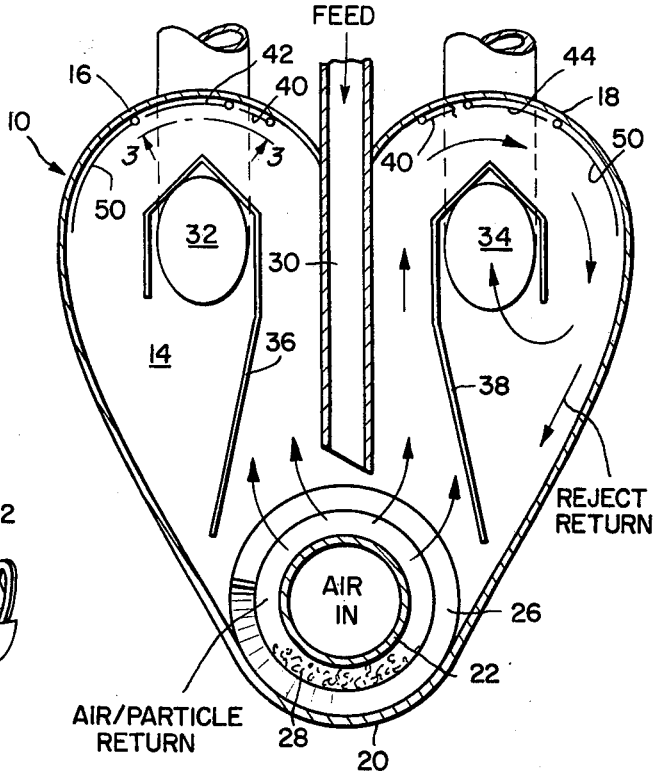
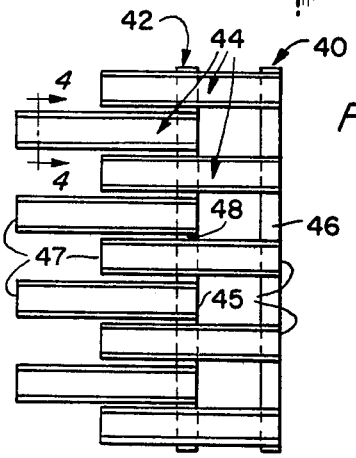
FIG. 3.
FIG. 5.
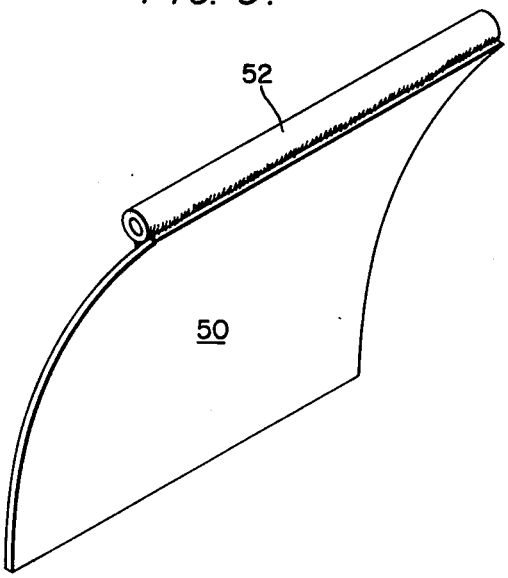
FIG. 4.
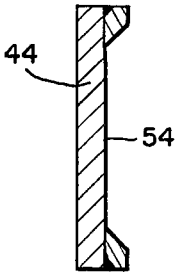

ADJUSTABLE PARTICLE CLASSIFIER

BACKGROUND OF THE INVENTION

This invention relates to classifiers and more particularly, it concerns an improved classifier construction which is adjustable to regulate the relative proportions of accepted and rejected solid particles suspended in a continuously flowing fluid stream.

In many industrial processes, there is a need for the separation of fluid-suspended solid particles on the basis of particle size or mass while the particles are in route to a point of use, application or treatment. For example, in the operation of power plants using pulverized coal for fuel, it is common practice to supply raw coal to a pulverizer in which multi-sized, relatively small particles are entrained in an air stream for supply as a combustible mixture. In its passage from the pulverizer, the air suspension of particles is passed through a classifier in which acceptable or relatively fine particles are allowed to pass from the classifier for combustion whereas unacceptable relatively coarse particles are rejected and returned to the pulverizer for further reduction in size. Such processes are usually continuous and, as such, restrict the range through which any one operation or step in the overall process may be varied without affecting other operations or steps.

A typical classifier for separating air-suspended particles in an industrial process may be in the nature of a heart-shaped enclosure having at its base, concentric ducting for feeding granular material such as raw coal and air to a ball mill pulverizer, for example, and for returning air-suspended particles to the enclosure. By appropriate baffling, the air suspension of particles is first directed upwardly so that a substantial portion of oversized particles will return by gravity to the pulverizer inlet ducting. As the air stream proceeds, it is passed in divergent arcuate or scroll-like paths enroute to discharge openings in the enclosure. By centrifugal force, unacceptably coarse particles move out of the air stream against the arcuate interior surfaces of the enclosure and fall to the bottom also for return to the pulverizer. Acceptably fine particles remain in the air stream and pass from the classifier to a point of use.

Although the relative percentages of particles passing from the classifier as against rejected particles returned to the pulverizer may vary with the velocity, temperature, and moisture content of the fluid or air stream as well as with particle size and shape, particle density and the like, the design of a classifier for a given process is dependent primarily on the size of ducting defined by the classifier enclosure and the radius of curvature through which the particle suspension is caused to pass. These latter parameters are usually fixed in prior art classifiers with the result that control over particle separation or classification is relatively restricted in a given installation.

In the operation of prior art classifiers of the aforementioned type in a pulverized coal burning system, there is a tendency for acceptably sized or fully pulverized particles of coal to collect on the interior surfaces of the arcuate walls defining the curved path for the air/coal suspension. Because the air velocity on the outside of the ducting or at the interior arcuate surface is relatively low, the fine particles will not be removed by the air but rather will tend to flake off from the surfaces as agglomerate chunks or particles of sufficient size and weight to cause their return to the pulverizer.

This characteristic, in turn, has resulted in unnecessary or excessive repulverization and corresponding loss of efficiency not only of the pulverizing step but of the overall process. While some measure of regulation is afforded by varying the temperature and velocity of the air stream passing through the pulverizer, these parameters of operation effect other steps in the overall process so that meaningful variation in the classifier involves a trade-off with other operational factors.

There is a need, therefore, for improvement in classifiers of the general type described so that controlled operation of the classifier may be effected independently of other variables required for the process or system in which the classifier is used.

SUMMARY OF THE PRESENT INVENTION

In accordance with the present invention, the arcuate or scroll-like interior surfaces of a particle classifier are provided with adjustable means for bringing all particles near or at the arcuate surface inwardly toward the center of the air flow. Preferably, such means is in the form of staggered arcuate fingers pivotal in regulated amounts into the air stream. The fingers are in successive sets lying in radial planes or transverse to the direction of flow along the interior arcuate surfaces with the fingers in the respective sets interleaved and extending parallel to the direction of flow. With both sets of fingers rotated into the air stream, particles are moved away from the arcuate reject surface so that relatively heavy particles must again pass through a zone of high velocity air flow to be rejected while the fine particles will be carried out by the air flow.

In addition, the effective velocity of air flow through the classifier is adjustable as a result of an arcuate solid plate following the fingers in the context of air flow direction. In addition to reducing the cross-section of the air stream, the solid plate has a tendency to collect more solid material and increase the reject rate.

A principal object of the present invention, therefore, is to provide an effective means for adjusting the relative percentages of accepted and rejected particles in a fluid stream used in a continuous industrial process. Other objects and further scope of applicability of the present invention will become apparent from the detailed description to follow taken in conjunction with the accompanying drawings in which like parts are designated by like reference numberals.

BRIEF DESCRIPTION OF THE DRAWINGS

FIG. 1 is a fragmented perspective view illustrating various operating components of an industrial classifier incorporating the present invention;

FIG. 2 is an enlarged vertical cross-section through the classifier illustrated in FIG. 1;

FIG. 3 is an enlarged bottom plan view taken on line 3—3 of FIG. 2;

FIG. 4 is an enlarged cross-section on line 4—4 of FIG. 3;

FIG. 5 is a perspective view illustrating an adjustable solid plate used in the invention;

DETAILED DESCRIPTION OF THE PREFERRED EMBODIMENT

Figure 6:
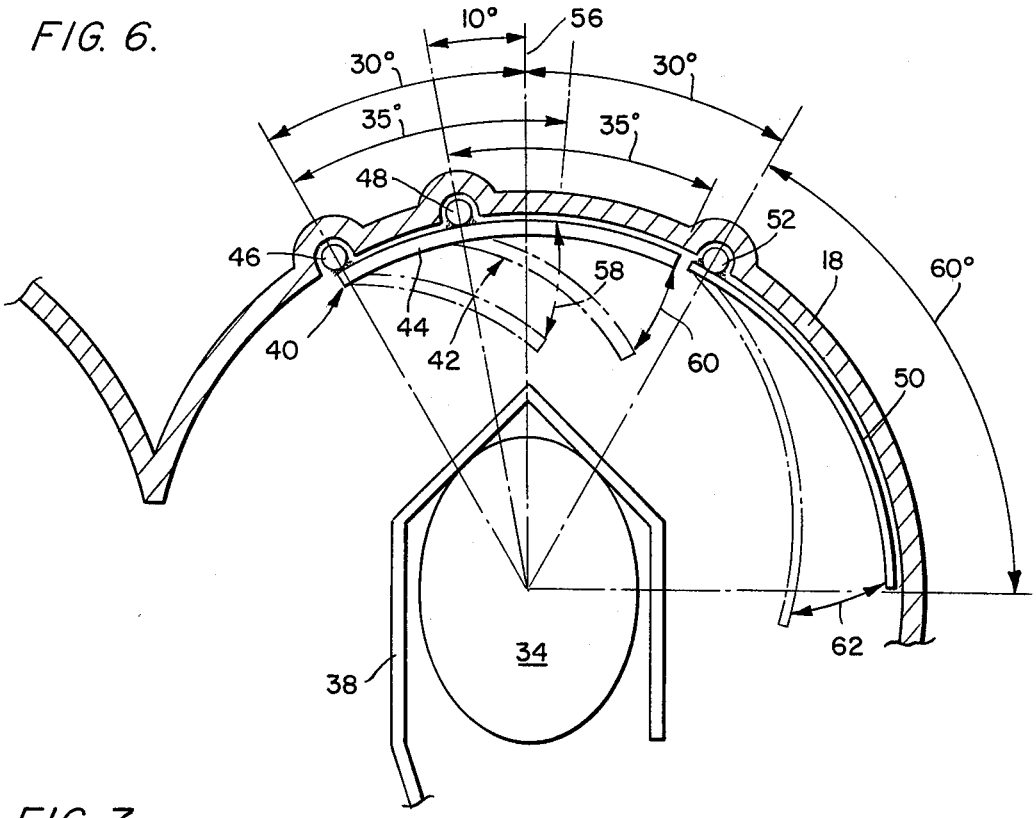
FIG. 6 is an enlarged fragmentary cross-section similar to FIG. 2 but illustrating in more detail the adjustable components of the invention.

In FIGS. 1 and 2 of the drawings, an embodiment of an adjustable classifier according to the invention is generally designated by the reference numeral 10 and shown as it would be used in a pulverized coal feeding system. Although the classifier 10 is particularly suited to this application and the detailed description to follow will be so directed, it is intended and to be understood that the invention is applicable broadly to particle classifiers in which a fluid suspension of particles is caused to pass in a curved path.

In the embodiment illustrated, the classifier 10 includes front and back, generally planar walls 12 and 14, respectively, joined by scroll-like transverse walls to define a pair of diverging arcuate wall portions 16 and 18 at the top of the classifier which extend outwardly and downwardly to merge in an arcuate base portion 20. As may be appreciated from FIG. 2, the identified walls and wall portions define a generally heart-shaped enclosure.

Extending through both the front and back walls 12 and 14 near the base of the classifier 10 is a closed circular air duct 22 joined at the end thereof adjacent the front wall 12 with a rectangular air feed duct which extends to a blower or other supply of preferably heated air (not shown). Behind the front wall 12, the circular air duct 22 is surrounded by a concentric helical discharge screw or conveyor 26 which is spaced from the exterior of the circular duct 22 by an annulus 28. The discharge screw 26 extends through the back wall 14 of the classifier within an exterior circular shroud or pipe 29 to a ball mill pulverizer (not shown).

In light of the organization of concentric components extending through the base of the classifier 10, the granular material to be pulverized, such as raw coal, is fed through a vertical feed chute 30 about the circular air duct 22 to the arcuate base 20 of the classifier. From this point it is fed by the conveyor 26 through the back wall 14 to the pulverizer (not shown). At the same time, air fed through the ducts 24 and 22 is directed to within the same pulverizer where it picks up multi-sized particles of pulverized material, in this instance coal particles, and passes back through the annulus 28 to the bottom of the enclosure defined by the classifier 10. Particles suspended in the air pass upwardly, around the arcuate upper wall portions 16 and 18 and through a pair of outlet openings 32 and 34 in the back wall 14 of the classifier 10. The passage of the air/particle suspension in this manner is assured by internal baffles 36 and 38 which extend between the front and back walls 10 and 14 and which, as shown most clearly in FIG. 2, extend about the upper portion of the outlet openings 32 and 34.

In the operation of classifiers of the general type represented by the illustrated embodiment, as the air suspension of multi-sized particles rises from the annulus 28, the largest of the particles will drop by gravity back to the base portion 20 of the classifier and be returned with the raw material fed by the conveyor 26. In passing upwardly between the baffles 36 and 38, the suspension is accelerated due to the reduction in cross-section effected by the lower portion of the baffles. Upon reaching the diverging arcuate wall portions 16 and 18, each of the diverging streams is carried through a curved duct-like formation defined at its outer boundary by the interior surfaces of the wall portions 16 and 18 and at its inner boundary by the top portions of the baffles 36 and 38. In passing the curved path to the outlets 32 and 34, relatively large and unacceptable particles will migrate outwardly of the curved path due to centrifugal force and return to the conveyor 26. Fine particles suspended in the stream will be passed through the openings 32 and 34.

In accordance with the invention, the interior surfaces of the arcuate wall portions 16 and 18 are provided with a succession of adjustable components by which the relative proportion of acceptably fine and unacceptably coarse particles may be adjusted or regulated without change in the total volume of material passing through the classifier. In particular, first and second sets 40 and 42 of fingers 44 supported on pivot shafts 46 and 48, respectively, are adjustably supported near the top of the arcuate wall portions 16 and 18 in advance of an arcuate plate 50 secured to a pivot shaft 52 and extending downwardly from the pivot shaft along the interior of each of the wall portions 16 and 18.

As shown most clearly in FIGS. 3 and 4 of the drawings, the fingers 44 of the respective sets 40 and 42 are in staggered overlapping relationship so as to be at least partially interleaved when in a retracted position against the interior surfaces of the wall portions 16 and 18. The several fingers 44 are substantially of the same structural conformation and as such, each finger is longitudinally curved, specifically arcuate in the illustrated embodiment, to complement the contour of the wall portions 16 and 18. The fingers extend longitudinally between leading and trailing ends 45 and 47, respectively and in the context of the direction of fluid flow. The leading ends are welded or otherwise fixed tangentially to the shafts 46 and 48. Each of the fingers 44 is, moreover, channel shaped as shown in FIG. 4 so as to present a concave inner surface 54 throughout the length thereof. As shown in FIG. 5, the plate 50 is a relatively smooth solid plate suitably fixed at its leading edge such as by welding on a tangent to the pivot shaft 52.

The preferred location of the finger sets 40 and 42 and the plate 50 in relation to each other and in relation to the arcuate surfaces 16 and 18 is depicted in FIG. 6 of the drawings. Also as shown in FIG. 6, the arcuate wall portions 16 and 18, in practice, will be recessed to accommodate the respective pivot shafts 46, 48, and 52 which are journalled in the end walls 12 and 14 of the classifier. By recessing the shafts in this manner, the fingers 44 as well as the plate 50 may occupy a retracted position against the inner surface of the arcuate walls 16 and 18 without effect on the operation of the classifier in a conventional sense.

In FIG. 6, the pivot axis position as well as the arcuate length of the fingers 44 and of the plate 50 are represented by specific angles from a vertical plane 56 intersecting the radial center of the arcuate wall portion 18. While the illustrated angular dimensions are believed preferable for the practice of the invention, the specific angular dimensions may vary from that shown in FIG. 6. Thus, the illustration of specific angles in FIG. 6 is not to be construed as restricting the broader aspects of the invention. Also in FIG. 6, the maximum throw of both sets of fingers 44 from a retracted position to a fully extended position into the air suspended particle stream is represented by identical angles 58 and 60. The throw of the solid plate 50 is represented by the angle 62. The preferred maximum pivotal adjustment of both finger sets 40 and 42 is approximately 30 degrees whereas it is preferred that the plate 50 be adjustable through a maximum range of approximately 20 degrees. The extended position of the fingers and plate, respectively, are represented by phantom lines in FIG. 6.

Figure 7:
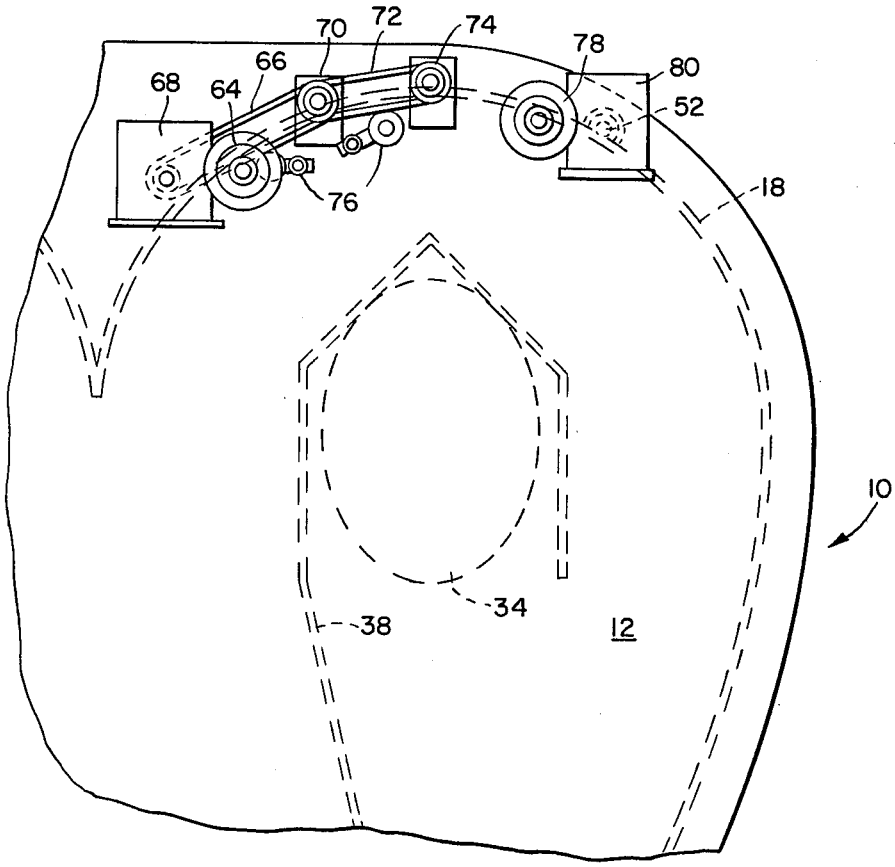
FIG. 7 is a fragmentary front elevation illustrating control components usable within the adjustable classifier of the present invention.

Although a variety of mechanisms may be employed to adjust the pivotal positions of the fingers 44 and of the plate 50, it is preferred that the finger sets 40 and 42 be linked to each other for simultaneous adjustment through the same pivot angle and that the plate 50 be adjustable independently of the fingers 44 for reasons which will be apparent from the description to follow below. Thus in FIG. 7, an exemplary system for adjusting the fingers 44 is shown to include a hand wheel 64 drivably connected with an endless chain 66 through a reduction unit 68. The chain 66 is engaged with one side of a double sprocket 70, the other side of which is engaged with a second endless drive chain 72. The sprocket 70 is keyed or otherwise coupled for direct rotation with the pivot shaft 46 of the first finger set 40. The second chain 72 extends to a sprocket 74 similarly coupled directly to the shaft 48 of the second finger set 42. Tensioning idlers 76 pivoted from the front wall 12 may be provided to retain the drive chains 68 and 72 under a proper tension in conventional fashion. In light of this organization, it will be appreciated that by rotation of the hand wheel 64, the chains will be driven in proportion to hand wheel rotation to adjust the pivotal angle of both finger sets 40 and 42. The reduction unit 68 is preferably irreversible (such as a worm gear drive) so that the finger sets will be retained in the position to which they are adjusted by rotation of the hand wheel 64.

The solid plate 52 is adjustable independently by a second hand wheel 78 associated with a reduction unit 80 having an output shaft keyed or otherwise coupled directly with the pivot shaft 52 of the plate 50. Thus, adjustment of the plate 50 is effected in the same manner as the fingers 44 but without need for the drive chain linkage of the shafts 46 and 48.

In the operation of the classifier 10, multi-sized particles, randomly dispersed throughout the stream passing upwardly between the baffles 36 and 38 will be accelerated and divided into diverging streams by the arcuate wall portions 16 and 18 and by the configuration of the baffles 36 and 38. Because the velocity of any fluid flowing within an enclosure is highest in the central area of the enclosure and lowest along the enclosure walls, and because relatively large particles are caused to move toward the outer enclosure wall by centrifugal force, the inner surfaces of the arcuate wall portions 16 and 18 act as collection surfaces for rejected particles. Particles collecting on the inner surfaces of the arcuate walls will not be re-entrained in the air stream due to the relatively low velocity of air near these surfaces. This is true also, however, of fine particles located close to the rejection surface defined by the inner side of the arcuate walls 16 and 18. The relatively low velocity of air or fluid along these boundary surfaces will have little effect on re-entraining the fine particles back into the air stream with the result that they will agglomerate and ultimately be returned with rejected particles to the base 20 of the classifier.

By adjusting the finger sets 40 and 42 so that the staggered and interleaved fingers 44 are pivoted into the stream, virtually all particle flow near the interior surfaces of the arcuate wall portions 16 and 18 will be directed inward toward the relatively high velocity central region of the stream flow. The channel-shaped inner surface 54 of each finger will retain particles until the end of each finger is reached. Also, it is to be noted that the space between the pivot shafts 46 and 48 of each finger sets 40 and 42 provides an area for fluid flow to pass through the interleaved fingers. In this manner, heavy particles must again pass through a zone of high velocity air flow to be rejected while fine particles will be carried out by the air flow due to an increase in the path of the rejection surface. Thus, movement of the fingers into the air flow tends to increase overall particle output and increase the percentage of acceptably fine particles passing through the outlets 30 and 34.

Adjustment of the arcuate plate 50 from its retracted position against the arcuate walls 16 and 18 into the air stream has the effect of increasing the relative percentage of particles to be rejected for return to the base of the classifier and repulverized. This occurs for two reasons. First, the discharge area is reduced thereby increasing the velocity of the air stream in the zone adjacent the plate 50 to increase the reject rate particularly of heavy particles. Secondly, the positioning of the solid plate 50 into the stream tends to collect more solid material thereby reducing the quantity of solid particles exposed to the higher central fluid velocities and decreasing the ability of the air or fluid to carry out material to the outlets 32 and 34.

In light of the foregoing, it will be appreciated that adjustment of the fingers 44 operates to re-introduce particle flow into the air stream to permit the dynamic effects of classification to be applied to virtually all particles which enter the classifier in a random pattern. In addition, variation of the position of the plate 50 will vary the location of the surface against which material is rejected to control the amount of material to be rejected.

Thus it will be appreciated that as a result of the present invention, a highly effective adjustable classifier is provided by which the principal objectives among others are fulfilled. Also, it will be apparent to those skilled in the art from the preceding description and accompanying drawing illustrations that variations may be made in the described embodiment without departure from the invention. Accordingly, it is expressly intended that the foregoing description and accompanying drawings are illustrative of a preferred embodiment only, not limiting, and that the true spirit and scope of the present invention be determined by reference to the appended claims.

I claim:

1. In a classifier for separating particles suspended in a fluid stream and having means defining a curved passageway through which the fluid stream is directed, such means including a inwardly facing reject surface at the outer boundary of the curved passageway and toward which surface particles are directed by centrifugal force, the classifier also having an outlet for accepted particles remaining in the stream throughout the length of said curved passageway, the improvement comprising:

a plurality of spaced, generally parallel fingers extending along the inner surface of said curved passageway in the direction of fluid stream flow and having leading and trailing ends in relation to said direction of fluid flow;

means to pivotally support said fingers at the leading ends thereof; and means for selectively pivoting said fingers to and from a projected position in which their trailing end portions project into said fluid stream.

2. In a classifier for separating particles suspended in a fluid stream and having means defining a curved passageway through which the fluid stream is directed, such means including an inwardly facing reject surface at the outer boundary of the curved passageway toward which surface particles are directed by centrifugal force, the classifier also having an outlet for accepted particles remaining in the stream throughout the length of said curved passageway, the improvement comprising:

first and second sets of spaced, generally parallel fingers, the ends of said first set of fingers lying between the fingers of said second set to present a staggered and interleaved array of said fingers;

means pivotally supporting said fingers for movement between a retracted position in which they extend in the direction of fluid stream flow to a projected position in which they project into said fluid stream; and means for adjusting said fingers between said positions.

3. The apparatus recited in claim 2 or 1, wherein said fingers are shaped to define a channel-like surface facing the fluid stream and extending through said leading and trailing ends.

4. The apparatus recited in claim 2 or 1, wherein said fingers are curved longitudinally to complement the shape of said reject surface when in said retracted position.

5. The apparatus recited in claim 2 or 1, wherein said means for adjusting said fingers comprises common means for adjusting both sets of said fingers through the same measure of adjustment.

6. The apparatus recited in claim 2 or 1, wherein said fingers are arcuate and each of an arc length approximating 35 degrees.

7. The apparatus recited in claim 6, wherein the leading ends of said fingers in said first and second sets are spaced by an arc distance approximating 20 degrees.

8. The apparatus recited in claim 7, wherein said fingers are pivotal through a maximum angle approximating 30 degrees.

9. The apparatus recited in either of claims 2 or 1, comprising a curved solid plate having leading and trialing edges and means for pivotally supporting said plate on a pivot axis located downstream from said finger means in terms of the direction of fluid flow and for pivotal movement of said plate between a retracted position against said reject surface and an extended position into the fluid stream.

10. The apparatus recited in claim 9, wherein said plate extends across the transverse dimension of said fluid stream to be effective in reducing the effective cross-sectional area of said stream when moved toward said extended position.

11. The apparatus recited in claim 10, wherein said plate is arcuate and of an arc length between leading and trailing edges approximating 60 degrees.

12. The apparatus recited in claim 11, wherein said plate is pivotal through a maximum angle approximating 20 degrees.

13. The apparatus recited in claim 12, comprising means to adjust said pivotal plate between said retracted and extended positions independently of movement of said fingers.

* * * * *